US008261849B2

(12) United States Patent
Kobayashi

(10) Patent No.: US 8,261,849 B2
(45) Date of Patent: Sep. 11, 2012

(54) JUMBO HAMMER CLUTCH IMPACT WRENCH

(75) Inventor: Shigeki Kobayashi, Nagano (JP)

(73) Assignee: SP Air Kabushiki Kaisha, Nagano (JP)

( * ) Notice: Subject to any disclaimer, the term of this patent is extended or adjusted under 35 U.S.C. 154(b) by 363 days.

(21) Appl. No.: 12/579,081

(22) Filed: Oct. 14, 2009

(65) Prior Publication Data

US 2010/0101815 A1 Apr. 29, 2010

Related U.S. Application Data

(60) Provisional application No. 61/108,756, filed on Oct. 27, 2008.

(51) Int. Cl.
*B25B 21/02* (2006.01)

(52) U.S. Cl. ..... 173/109; 173/112; 173/218; 173/122; 173/128; 173/93; 173/93.5

(58) Field of Classification Search ..... 173/109, 173/112, 218, 122, 128, 93, 93.5
See application file for complete search history.

(56) References Cited

U.S. PATENT DOCUMENTS

| | | | | |
|---|---|---|---|---|
| 3,661,217 | A | 5/1972 | Maurer | |
| 4,184,552 | A * | 1/1980 | Anderson | 173/93.5 |
| 4,321,973 | A | 3/1982 | Maurer | |
| 4,346,630 | A | 8/1982 | Hanson | |
| 4,669,551 | A * | 6/1987 | Lippacher et al. | 173/109 |
| 4,805,706 | A | 2/1989 | Stone | |
| 4,821,611 | A | 4/1989 | Izumisawa | |
| 4,919,022 | A * | 4/1990 | Ono et al. | 81/464 |
| 33,711 | A | 10/1991 | Ono et al. | |
| RE33,711 | E * | 10/1991 | Ono et al. | 81/464 |
| 5,199,505 | A | 4/1993 | Izumisawa | |
| 6,044,917 | A * | 4/2000 | Brunhoelzl | 173/93.5 |
| 6,560,174 | B1 | 5/2003 | Takenaka | |
| 6,578,643 | B2 | 6/2003 | Izumisawa | |
| 7,080,578 | B2 | 7/2006 | Izumisawa | |
| 2006/0011363 | A1 * | 1/2006 | Chang | 173/93.5 |
| 2010/0064864 | A1 * | 3/2010 | Kobayashi | 81/464 |

FOREIGN PATENT DOCUMENTS

| | | | |
|---|---|---|---|
| CN | 1241154 | A | 1/2000 |
| WO | 9917909 | A1 | 4/1999 |

OTHER PUBLICATIONS

Office Action dated May 8, 2012, Japanese Patent Application No. 2009-245722, 2 pages.

* cited by examiner

*Primary Examiner* — Brian D Nash
(74) *Attorney, Agent, or Firm* — Senniger Powers LLP

(57) ABSTRACT

A power driven tool for rotating a mechanical element. The tool includes a housing and motor. The motor has an output shaft. The shaft rotates relative to the housing. The tool also includes an impact drive axially fixed within the housing. The impact drive includes a base and an anvil shaft having an anvil. The impact drive includes an annular hammer having opposite impact lands pivotally mounted on the base for movement between three positions, including a forward position in which the hammer is positioned so one impact land engages the anvil, a reverse position in which the hammer is positioned so another of the impact lands engages the anvil, and a disengaged position in which neither of the impact lands engages the anvil. Further, the tool includes a ratchet mechanism. The ratchet mechanism includes an output drive mounted for rotation relative to the housing for rotating a mechanical element.

14 Claims, 5 Drawing Sheets

JUMBO HAMMER CLUTCH IMPACT WRENCH

CROSS-REFERENCE TO RELATED APPLICATION

Priority is claimed from U.S. Provisional Patent Application Ser. No. 61/108,756 filed Oct. 27, 2008, which is hereby incorporated by reference.

BACKGROUND OF THE INVENTION

This invention relates generally to power driven tools, and more specifically to a power driven tool for tightening or loosening fasteners including an impact drive having an oversized hammer clutch.

Power driven tools for tightening or loosening fasteners (e.g., nuts and bolts) are known, and power driven tools incorporating impact drives that can intermittently provide increased torque for tightening or loosening fasteners are common.

An impact wrench incorporating a ratchet head is disclosed in co-owned U.S. Pat. No. 4,821,611, which is incorporated by reference. A pneumatic motor rotates a clutch case that coaxially houses an impact drive. Under normal operation, a cam ball in the clutch case engages a finger of an impact clutch and rotates the clutch with an output shaft for tightening or loosening the fastener. But when frictional resistance of the fastener exceeds a preselected torque output for the tool, the cam ball slides under the impact clutch finger and pushes the clutch axially forward along the output shaft. This action moves a pair of hammers forward into alignment with a corresponding pair of anvils of the output shaft. The hammers simultaneously impact the anvils producing an increased torque in the output shaft, increasing torque applied to the fastener and acting to overcome the frictional resistance of the fastener. Immediately following the impact, the hammers retreat axially rearward and when the cam ball makes one full rotation with the clutch case, the impact sequence repeats if frictional resistance exceeds the preselected torque of the tool.

The clutch case and cam ball generally move at a rate equal to the output speed of the motor, which is relatively fast. Therefore, when the output shaft is unable to turn the fastener, the cam ball repeatedly pushes the impact clutch and hammers axially forward. This action often occurs so rapidly that the hammers impact the anvils before corresponding surfaces are fully aligned, or alternatively the hammers completely miss the anvils and fail to produce any additional torque. Moreover, when the frictional resistance of the fastener exceeds the additional torque produced by the hammers, the cam ball and impact clutch may unnecessarily push the hammers into repeated alignment with the anvils before an operator disengages the motor. This repeated impact and movement can damage components of the impact drive (e.g., the cam ball and impact clutch) or prematurely wear them out.

Co-owned U.S. Pat. No. 7,080,578, which is incorporated by reference, includes a speed reducing mechanism in the power driven impact wrench. This particular design reduces the speed of the motor output and controls the impact rate of the hammers of the impact drive. Although the components of the impact drive are less prone to damage and wear, the speed reducing mechanism requires the use of additional components adding complexity to the tool.

Accordingly, there is a need for a power driven ratchet tool having an impact drive capable of providing adequate damage and wear protection without using a speed reducing mechanism.

SUMMARY OF THE INVENTION

This invention relates generally to a power driven tool for rotating a mechanical element. The tool comprises a housing and a motor positioned in the housing. The motor has an output shaft extending therefrom. The shaft rotates relative to the housing during motor operation. Further, the tool includes an impact drive axially fixed within the housing and operatively connected to the motor output shaft. The impact drive including a base, an anvil shaft having an anvil extending therefrom rotatably mounted on the base, and an annular hammer having opposite impact lands pivotally mounted on the base for movement between three positions. The three positions included a forward position in which the hammer is positioned so one of the impact lands engages the anvil, a reverse position in which the hammer is positioned so another of the impact lands engages the anvil, and a disengaged position in which neither of the impact lands engages the anvil. In addition, the tool comprises a ratchet mechanism operatively connected to the anvil shaft of the impact mechanism. The ratchet mechanism includes an output drive mounted for rotation relative to the housing for rotating a mechanical element in a selected direction.

In another aspect of the invention, a power driven tool for tightening and loosening a mechanical fastener, the tool comprises a housing having first and second ends and a longitudinal axis extending between the first and second ends. The tool also includes an output drive rotatably mounted on the housing for operatively engaging the mechanical fastener and a motor positioned in the housing having an output shaft. Further, the tool includes an impact drive positioned in the housing and functionally connecting the motor and the output drive. The impact drive including a base, an anvil shaft having an anvil extending therefrom rotatably mounted on the base, and an annular hammer having opposite impact lands pivotally mounted on the base for movement between three positions, including a forward position in which the hammer is positioned so one of said impact lands engages the anvil, a reverse position in which the hammer is positions so another of said impact lands engages the anvil, and a disengaged position in which neither of the impact lands engages the anvil.

In yet another aspect of the invention, a pneumatic tool for tightening and loosening a mechanical fastener comprises an elongate tubular housing sized for being held in one hand. The tool includes a pneumatic motor in the housing having an output shaft adapted for rotation and an impact drive axially fixed within the housing and operatively connected to the motor output shaft. The impact drive includes a base and an anvil shaft having an anvil extending therefrom rotatably mounted on the base. The impact drive also includes an annular hammer having opposite impact lands pivotally mounted on the base for movement between three positions, including a forward position in which the hammer is positioned so one of said impact lands engages the anvil, and a reverse position in which the hammer is positioned so another of said impact lands engages the anvil. The hammer impacts the anvil on the shaft in response to loading on the impact drive exceeding a predetermined torque to instantaneously increase torque provided to the anvil shaft. Further, the tool includes a ratchet mechanism operatively connected to the anvil shaft of the impact mechanism. The ratchet mechanism includes an output drive mounted for rotation relative to the housing for rotating a mechanical element in a selected direction.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
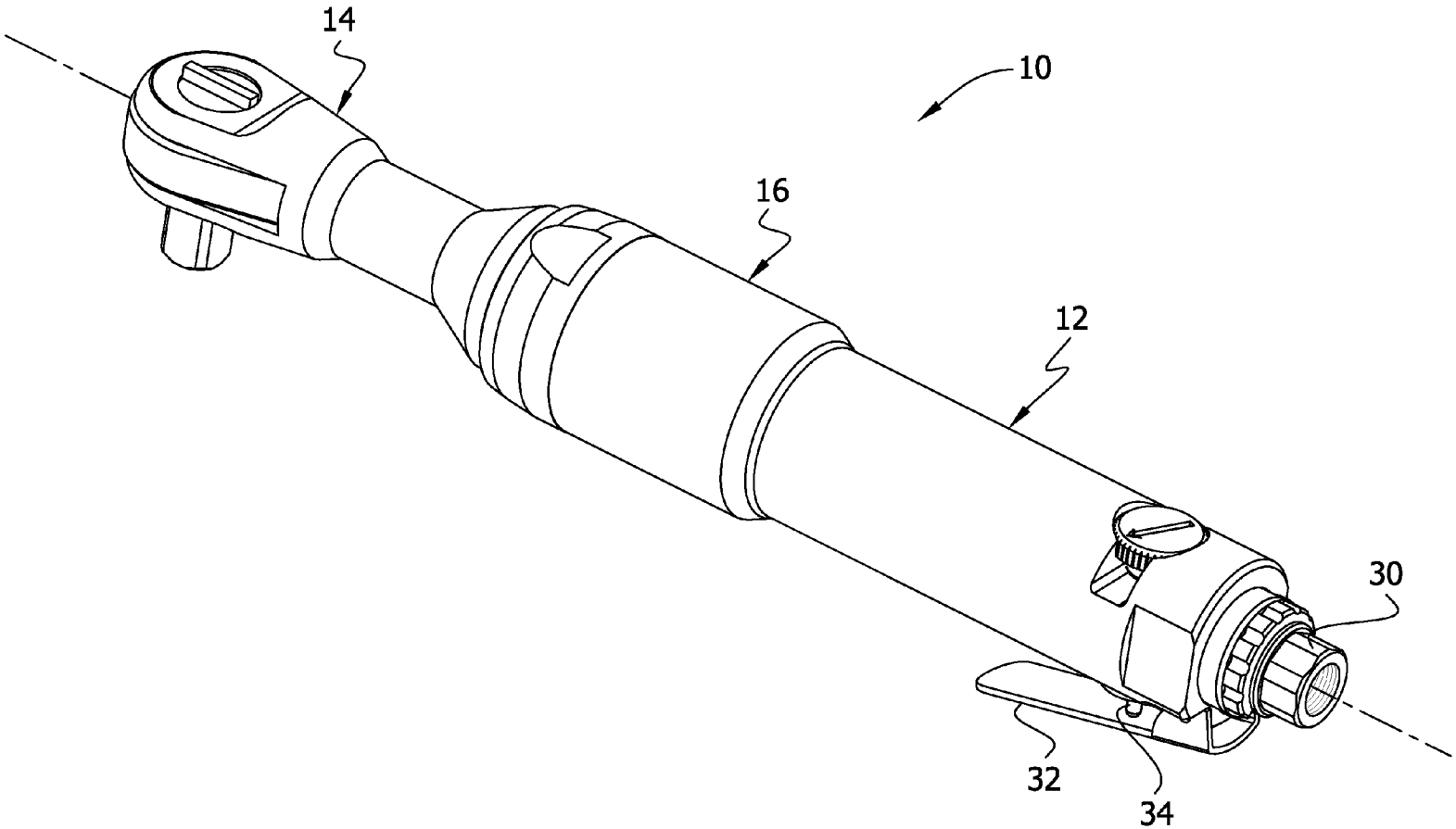
FIG. 1 is a perspective of a hand-held pneumatic ratchet wrench of the invention incorporating an impact drive and pneumatic motor.
Figure 2:
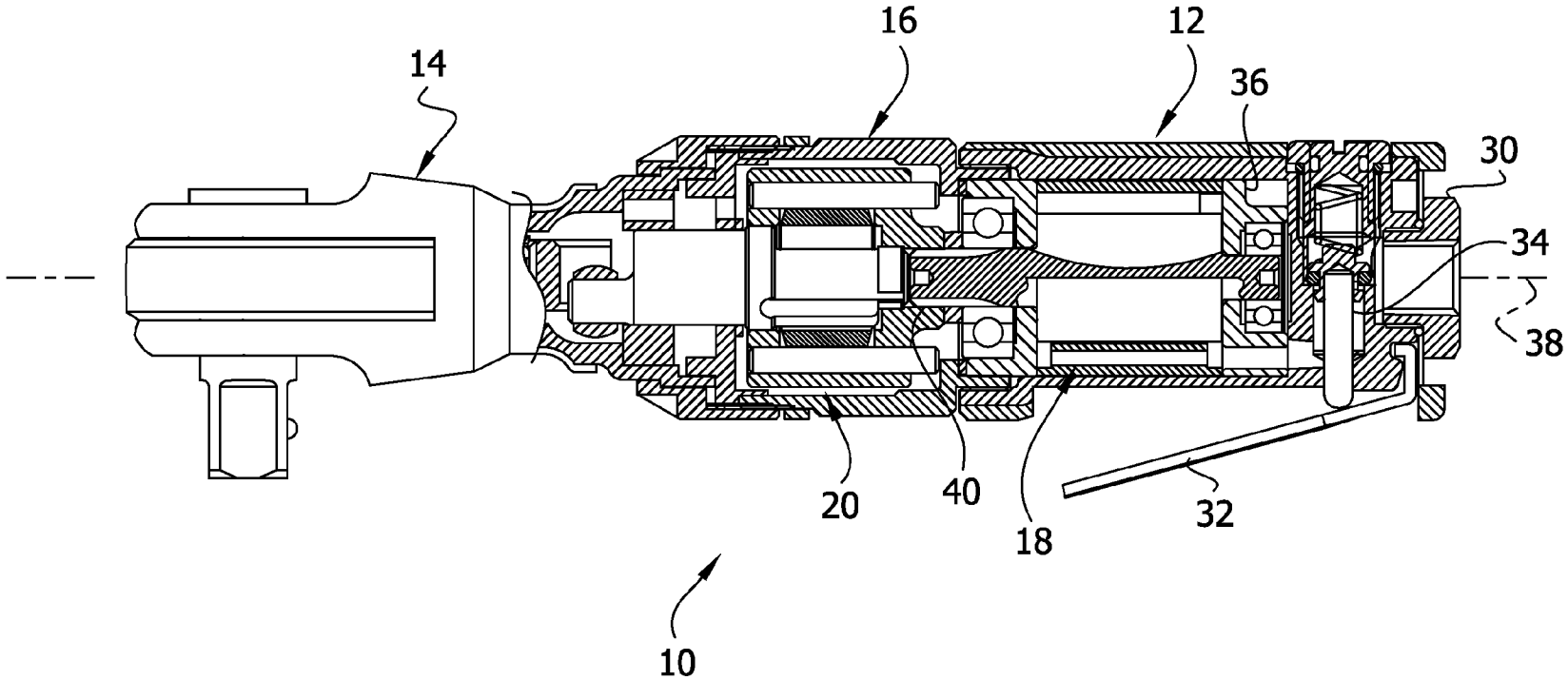
FIG. 2 is an elevation of the wrench of FIG. 1 in partial section to show internal construction.
Figure 3:
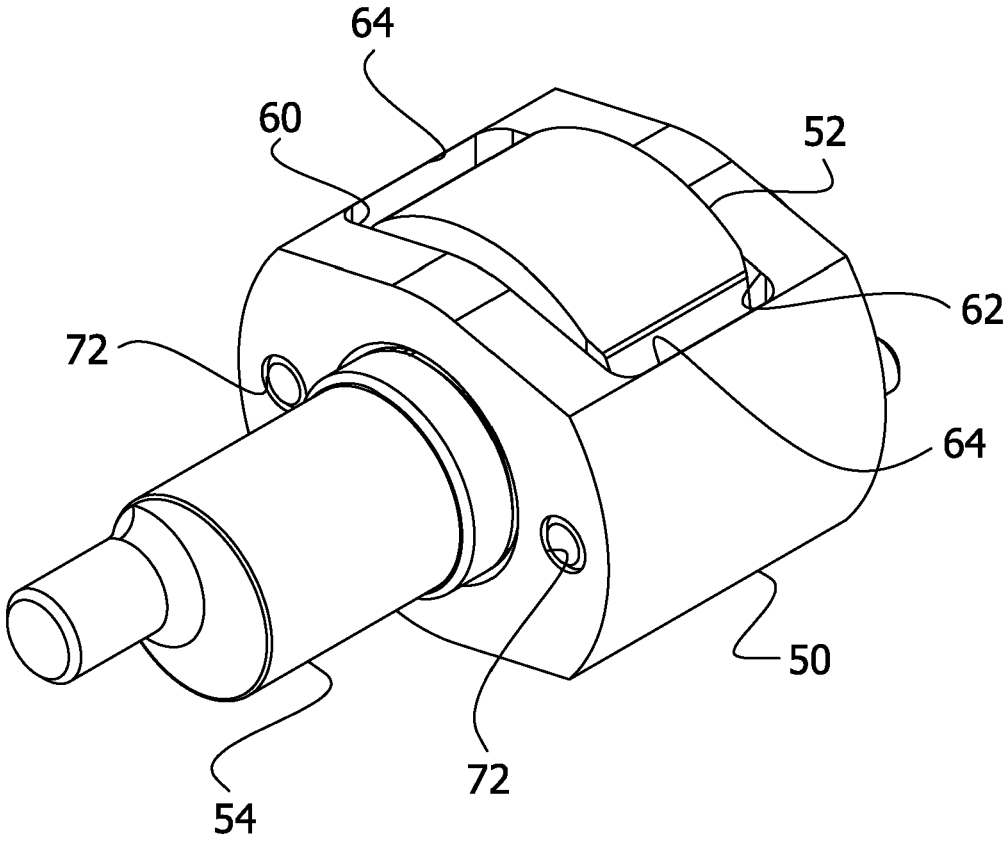
FIG. 3 is a perspective of an impact drive of the wrench.

Referring now to the drawings, and particularly to FIGS. 1 and 2, a hand-held, pneumatically-driven, ratchet wrench is generally indicated at reference numeral 10. The wrench 10 includes a tubular grip, indicated generally at 12, and a head, indicated generally at 14. As shown in FIG. 2, the grip 12 and head 14 are connected by a tubular threaded coupling, generally indicated at 16, so the grip, coupling and head form a housing that houses the functional components of the wrench 10. The grip 12 houses a motor, which is generally indicated at 18. The coupling 16 houses an impact drive, generally designated by 20 and the head 14 houses a ratchet mechanism, generally designated by 22 (FIG. 3). Each of these components will be described in greater detail below. For convenience of description, when describing orientations of components, a forward end of the wrench 10 will be understood to be at an end having the head 14 and a rearward end will be understood to be at an end having the grip 12. The motor 18 illustrated and described is a standard, air-driven motor of the type commonly used in pneumatic tools. Because the motor 18 is conventional, it will not be described in further detail.

Referring to FIG. 1, an air inlet fitting 30 provided at the rearward end of the grip 12 is capable of connecting the wrench 10 to a conventional external pressurized air source (not shown). A lever 32 provided adjacent the grip 12 controls fluid flow to the motor 18. The lever 32 is pivotally mounted on the grip 12 and is spring biased to an extended position as shown so that it can be squeezed toward the grip to open a valve 34 to selectively permit pressurized air to flow through the air inlet fitting 30 to the motor 18. As shown in FIG. 2, the motor 18 includes a rotor 36 rotatably mounted on the grip 12 for rotation about a centerline 38. The rotor 36 rotates in response to air passing through the motor 18 when the valve 34 is open. The rotor 36 includes an output shaft 40 centered on the centerline 38. Although the output shaft 40 may has other shapes without departing from the scope of the present, in one embodiment the shaft has a generally cylindrical, splined (i.e., ridged) exterior for connecting the shaft to the impact drive.

Figure 4:
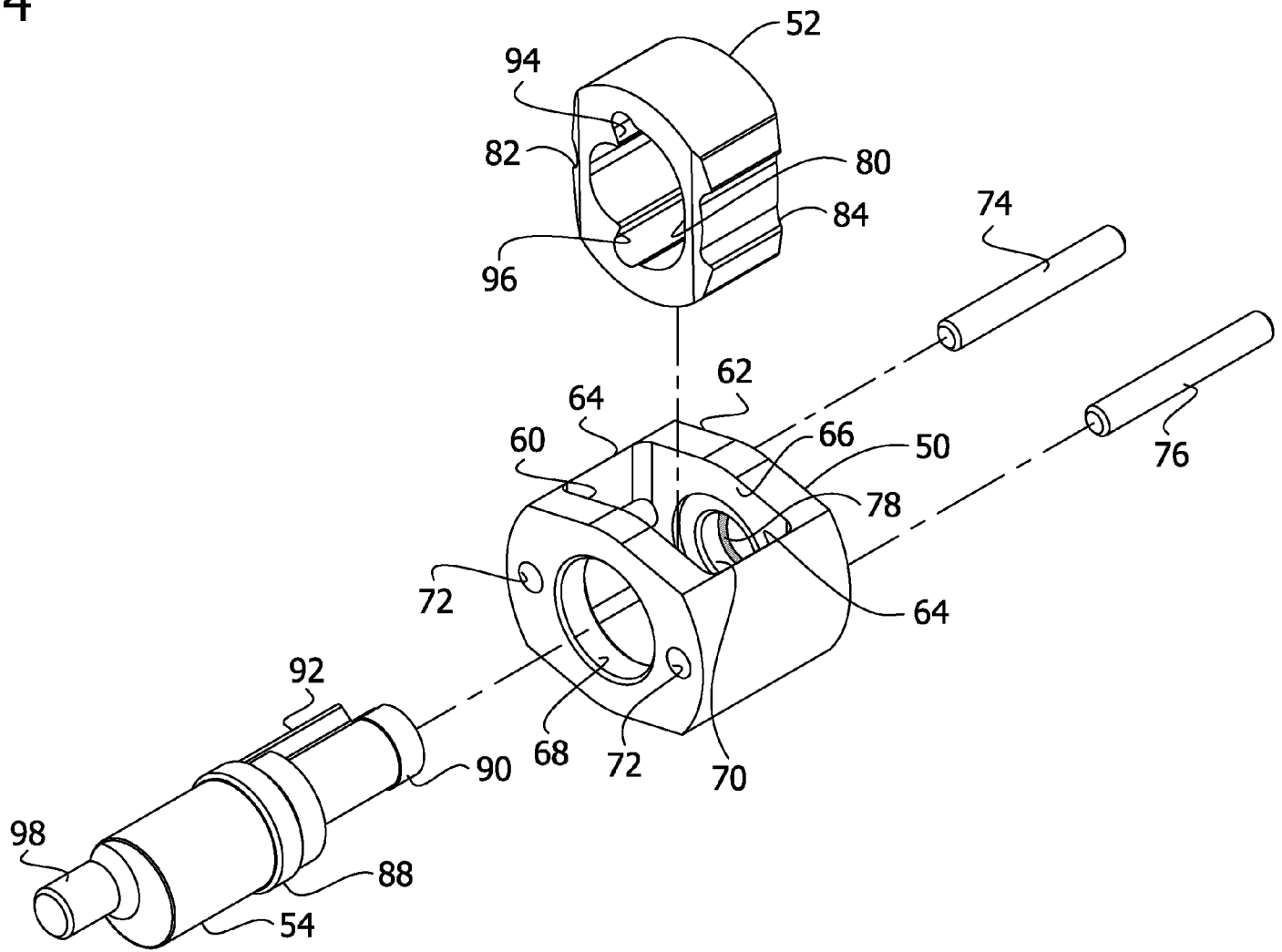
FIG. 4 is a separated perspective of the impact drive.

As illustrated in FIGS. 3 and 4, the impact drive 20 of the wrench 10 generally comprises a clutch base 50, a hammer 52 and an anvil shaft 54. As further illustrated in FIG. 4, the base 50 includes forward and rearward bushing plates 60, 62, respectfully, separated by integral spacers 64 creating a space 66 between the plates for receiving the hammer 52. Each of the bushing plates 60, 62 includes a respective machined central opening 68, 70 for receiving the shaft 54. Holes 72 are provided on opposite sides of the openings 68, 70 for receiving pins 74, 76 that capture the hammer 52 in the space 66 formed between the plates 60, 62. A portion 78 of the rearward central opening is 68 splined for receiving the splined output shaft 40 of the motor 18. Thus, the base 50 turns with the motor rotor 36. The hammer 52 includes a lobed central opening 80, a semi-circular slot 82 on one side and broad slot 84 on an opposite side. The slots 82, 84 receive the pins 74, 76 so they extend between the plates 60, 62 for retaining the hammer 52 in the space 66. As will be appreciated by those skilled in the art, the semi-circular slot 82 and the pin 74 permit the hammer 52 to pivot. The broad slot 84 and pin 76 limit rotation of the hammer 52 as it pivots on pin 74. The anvil shaft 54 extends through the central openings 68, 70 of the bushing plates 60, 62 and the lobed central opening 80 of the hammer 52. The shaft 54 also has spaced journals 88, 90 corresponding to the central openings 68, 70 in the plates 60, 62. The journals 88, 90 engage the central openings 68, 70 for supporting the shaft 54 and permitting the shaft to rotate in the base 50. An anvil 92 is provided on the shaft 54 between the journals 86, 88 so lands 94, 96 in the lobed opening 80 of the hammer 52 can intermittently engage the anvil to provide increased torque as will be explained in greater detail below. In addition, the shaft 54 includes a crank 98 at its forward end for driving the ratchet mechanism 22.

Figure 5:
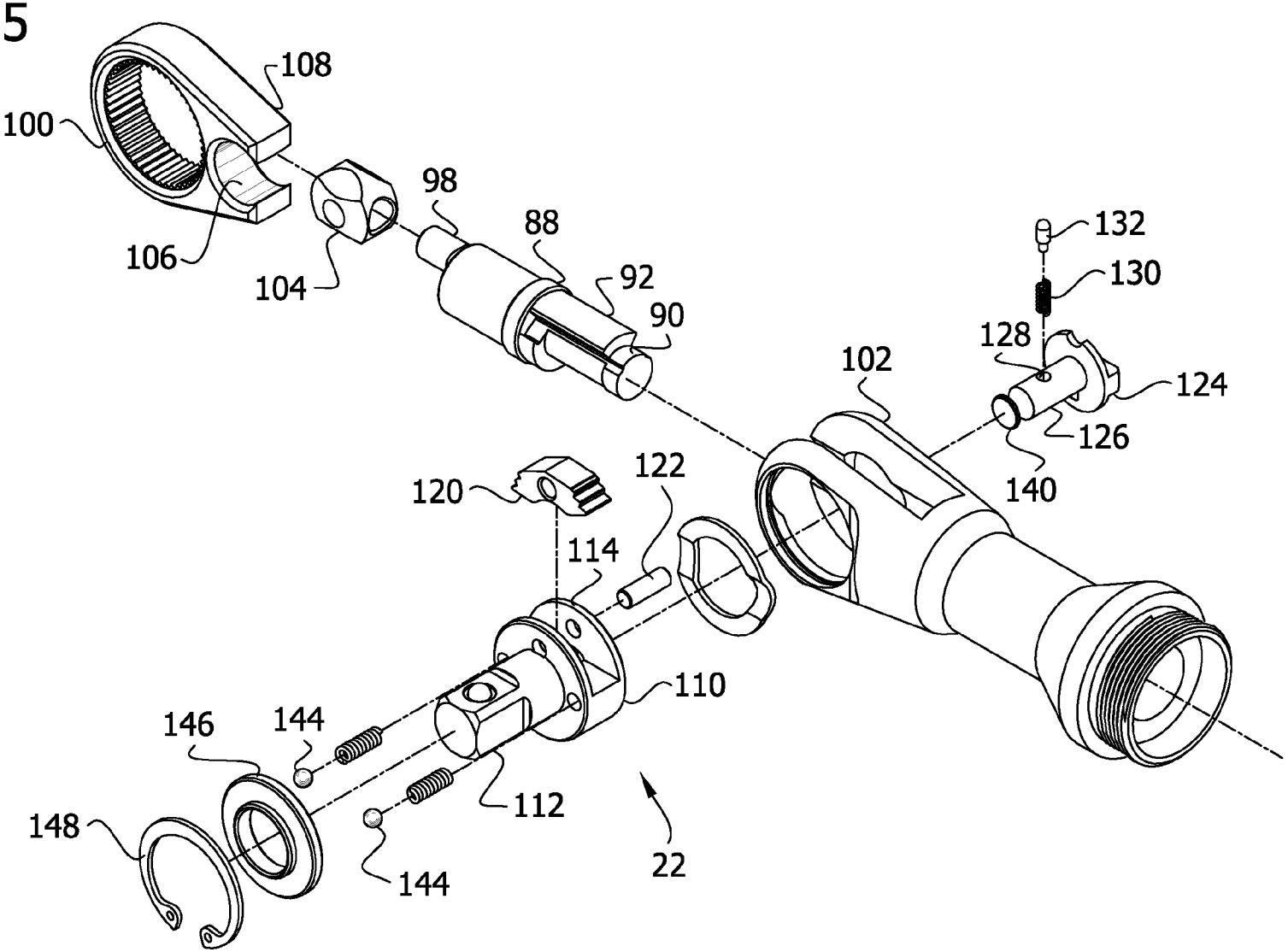
FIG. 5 is a separated perspective of a ratchet mechanism of the wrench.

FIG. 5 illustrates the ratchet mechanism 22 of the wrench 10 which converts orbital motion of the crank 98 to rotational motion in a selected direction. The crank 98 drives an internal ring gear 100 to oscillate back and forth in a yoke 102 of the head 14. The crank 98 and ring gear 100 are operationally connected by a bushing 104 that is received in a generally cylindrical opening 106 of an arm 108 extending from the ring gear. A drive body 110 is rotatably mounted inside the ring gear 100. The drive body 110 includes square output drive 112 and a dog carrier 114. A pivotal ratchet dog or ratchet pawl 120 is pivotally captured in the dog carrier 114 by a pin 122. The dog 120 is biased to pivot in one selected direction by a selector knob 124. The selector knob 124 includes a shaft 126 that extends inside the dog carrier 114. The shaft 126 has a recess 128 that holds a spring 130 for biasing a pusher 132 against the dog 120. The pusher 132 pushes the dog 120 in a selected direction so the ring gear 100 drives the drive body 110 in one direction but not in the other direction as the ring gear oscillates back and forth. A axial bushing pad 140 is positioned between the shaft 126 of the selector knob 124 and the drive body 110, and a keeper 142 is positioned between the drive body and the yoke 102 of the head 14. Spring biased bearings 144 and a race 146 allow the drive body 110 to spin freely in the head 14. A snap ring 148 retains the race 146 in position in the head 14. The illustrated ratchet mechanism 22 is similar to that shown in U.S. Pat. No. 4,346,630, generally including an output drive 112 rotatably mounted on the head 14 for engaging a mechanical fastener. The ratchet mechanism 22 selectively limits rotation of the output drive 112 in one direction. Because the ratchet mechanism 22 is conventional, it will not be described in further detail.

In general operation of the wrench 10, air enters through the air inlet fitting 30 at the rearward end of the grip 12 when the lever 32 is squeezed toward the grip. The air enters the motor 18 where it rotates the rotor 36 including the output shaft 40. The motor shaft 36 rotates the clutch base 50. When required torque is low, the clutch base 50 turns the hammer 52 which engages the anvil 92 to turn the shaft 54. The crank 98 orbits the wrench centerline 38, oscillating the ring gear 100.

As the ring gear 100 oscillates in one direction, the dog 120 pivots into the dog carrier 114 so the output drive 112 does not turn. As the gear 100 oscillates in another direction, the dog 120 engages the gear so the output drive 112 turns with the gear. When the required torque exceeds some preselected value, the hammer 52 pivots on the pin 74, disengaging the engaged hammer land 94 or 96 from the anvil 92 on the shaft 54 and temporarily preventing the crank 98 from driving the ratchet mechanism 22. After the anvil 92 passes the hammer land 94 or 96, the hammer 62 pivots back to a position in which the land engages the anvil 92 on the next revolution. When the combined spinning mass of the motor rotor 36, base 60 and hammer 52 acts through the hammer to impact the anvil 92 on the next revolution, an instantaneous torque increase occurs. The torque increase acts to overcome the friction in the mechanical fastener. If the torque exceeds the preselected value on the next revolution the sequence repeats. Otherwise, the impact drive 20 delivers continuous toque.

It is envisioned that the wrench of the present invention can operate at relatively high pressures thus producing relatively high rotational speeds with the motor shaft of the motor. It is therefore a benefit of this wrench 10 that the impact drive 20 is capable of handling high pressures without a speed reducing mechanism or excessively wearing components.

Components of the wrench of this invention are made of a suitable rigid material, such as metal (ex., cold-forged steel). But a wrench having components made of different materials does not depart from the scope of this invention.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above construction without departing from the scope of the invention, it is intended that all matter contained in the above description and shown in the accompanying drawings shall be interpreted as illustrative and not in a limiting sense.

What is claimed is:

1. A power driven tool for rotating a mechanical element, the tool comprising:

a housing;

a motor positioned in the housing having an output shaft extending therefrom, said shaft rotating relative to the housing during motor operation;

an impact drive axially fixed within the housing and operatively connected to the motor output shaft, the impact drive including a base, an anvil shaft having an anvil extending therefrom rotatably mounted on the base, and an annular hammer having opposite impact lands pivotally mounted on the base for movement between three positions, including a forward position in which the hammer is positioned so one of said impact lands engages the anvil, a reverse position in which the hammer is positioned so another of said impact lands engages the anvil, and a disengaged position in which neither of the impact lands engages the anvil; and a ratchet mechanism operatively connected to the anvil shaft of the impact mechanism, the ratchet mechanism including an output drive mounted for rotation relative to the housing for rotating a mechanical element in a selected direction;

the tool being free of a speed reducing mechanism and configured to provide of a speed reducing mechanism.

2. A power driven tool as set forth in claim 1 wherein the ratchet mechanism comprises an oscillating ring gear operatively connected to the anvil shaft of the impact drive.

3. A power driven tool as set forth in claim 2 wherein the ratchet mechanism further comprises a dog driven by the ring gear for driving the output drive.

4. A power driven tool as set forth in claim 1 wherein the hammer rotates with the base in response to the rotation of the motor drive.

5. A power driven tool as set forth in claim 1 wherein the hammer is mounted on the base for pivotal movement about a corresponding axis extending parallel to a longitudinal axis of the housing.

6. A power driven tool as set forth in claim 1 wherein the motor is a pneumatic motor.

7. A power driven tool as set forth in claim 6 wherein the housing includes a head and a grip positioned opposite the head for grasping the tool to hold the tool, the grip including an air inlet fitting and a lever for controlling air flow to the motor.

8. A power driven tool for tightening and loosening a mechanical fastener, the tool comprising:

a housing having first and second ends and a longitudinal axis extending between the first and second ends;

an output drive rotatably mounted on the housing for operatively engaging the mechanical fastener;

a motor positioned in the housing having an output shaft;

an impact drive positioned in the housing and functionally connecting the motor and the output drive, the impact drive including a base, an anvil shaft having an anvil extending therefrom rotatably mounted on the base, and an annular hammer having opposite impact lands pivotally mounted on the base for movement between three positions, including a forward position in which the hammer is positioned so one of said impact lands engages the anvil, a reverse position in which the hammer is positions so another of said impact lands engages the anvil, and a disengaged position in which neither of the impact lands engages the anvil;

the tool being free of a speed reducing mechanism and configured to provide of a speed reducing mechanism.

9. A power driven tool as set forth in claim 8 wherein the hammer is mounted on the base for pivotal movement about a corresponding axis extending parallel to a longitudinal axis of the housing.

10. A power driven tool as set forth in claim 8 wherein the hammer rotates with the base in response to the rotation of the motor.

11. A power driven tool as set forth in claim 8 wherein the motor is a pneumatic motor.

12. A power driven tool as set forth in claim 8 wherein the housing includes a grip for grasping the tool, the grip including an air inlet fitting and a lever for controlling air delivery to the motor.

13. A pneumatic tool for tightening and loosening a mechanical fastener, the tool comprising:

an elongate tubular housing sized for being held in one hand;

a pneumatic motor in the housing having an output shaft adapted for rotation;

an impact drive axially fixed within the housing and operatively connected to the motor output shaft, the impact drive including a base, an anvil shaft having an anvil extending therefrom rotatably mounted on the base, and an annular hammer having opposite impact lands pivotally mounted on the base for movement between three positions, including a forward position in which the hammer is positioned so one of said impact lands engages the anvil, and a reverse position in which the hammer is positioned so another of said impact lands engages the anvil, the hammer impacting the anvil on the shaft in response to loading on the impact drive exceeding a predetermined torque to instantaneously increase torque provided to the anvil shaft; and a ratchet mechanism operatively connected to the anvil shaft of the impact mechanism, the ratchet mechanism including an output drive mounted for rotation relative to the housing for rotating a mechanical element in a selected direction;

the tool being free of a speed reducing mechanism and configured to provide of a speed reducing mechanism.

14. A power driven tool as set forth in claim 13 wherein the anvil shaft is separately rotatably from the base.

* * * * *

UNITED STATES PATENT AND TRADEMARK OFFICE

CERTIFICATE OF CORRECTION

PATENT NO. : 8,261,849 B2
APPLICATION NO. : 12/579081
DATED : September 11, 2012
INVENTOR(S) : Shigeki Kobayashi It is certified that error appears in the above-identified patent and that said Letters Patent is hereby corrected as shown below:

In Column 6, Line 2, please replace "of a speed reducing mechanism" with --damage and wear protection without the use of a speed reducing mechanism--.

In Column 6, Line 43, please replace "of a speed reducing mechanism" with --damage and wear protection without the use of a speed reducing mechanism--.

In Column 8, Line 5, please replace "of a speed reducing mechanism" with --damage and wear protection without the use of a speed reducing mechanism--.

Signed and Sealed this
Twenty-sixth Day of March, 2013

Teresa Stanek Rea
*Acting Director of the United States Patent and Trademark Office*